US007472431B2

(12) United States Patent
Larsen

(10) Patent No.: US 7,472,431 B2
(45) Date of Patent: Jan. 6, 2009

(54) MULTIPLE NOZZLE MOVING JET STRUCTURE FOR SPA

(75) Inventor: Christopher Larsen, Vista, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 439 days.

(21) Appl. No.: 10/899,547

(22) Filed: Jul. 27, 2004

(65) Prior Publication Data

US 2006/0021130 A1 Feb. 2, 2006

(51) Int. Cl.
*A61H 33/04* (2006.01)

(52) U.S. Cl. ..... 4/541.6; 4/541.1

(58) Field of Classification Search ..... 4/541.1–541.6
See application file for complete search history.

(56) References Cited

U.S. PATENT DOCUMENTS 4,419,775 A * 12/1983 Ebert ..... 4/541.4
4,523,340 A 6/1985 Watkins
4,716,604 A 1/1988 Watkins
4,764,999 A * 8/1988 Rushing ..... 4/541.6
4,920,588 A 5/1990 Watkins
5,809,648 A * 9/1998 Kurth et al. ..... 4/541.6
6,092,246 A * 7/2000 Ludlow ..... 4/541.6
6,108,829 A * 8/2000 Wadsworth ..... 4/541.3
6,178,570 B1 * 1/2001 Denst et al. ..... 4/541.6
6,182,303 B1 * 2/2001 Gardenier et al. ..... 4/541.6
6,681,414 B1 * 1/2004 May et al. ..... 4/541.6
6,848,637 B2 * 2/2005 Holtsnider ..... 4/541.6
7,043,775 B2 * 5/2006 Holtsnider et al. ..... 4/541.6

FOREIGN PATENT DOCUMENTS

EP WO 86/01100 * 2/1986
GB 2224203 A * 2/1990

* cited by examiner

*Primary Examiner*—Khoa D Huynh
(74) *Attorney, Agent, or Firm*—Leon E. Redman

(57) ABSTRACT

A multiple nozzle moving jet structure for a spa, attached to flexible tubes encased in an articulated sleeve exhausts pressurized water into the spa in a vertical whipping motion, in reaction to the water exhaust. The multiple nozzle structure utilizes one air supply tube to aerate water streams of the multiple nozzle structure. The combination of the multiple nozzle structure with the articulated sleeves on the flexible tubes, confines movement of the nozzle structure in one plane, eliminating the requirement for a guide body to confine direction of nozzle movement.

8 Claims, 3 Drawing Sheets

FIG. 1
PRIOR ART
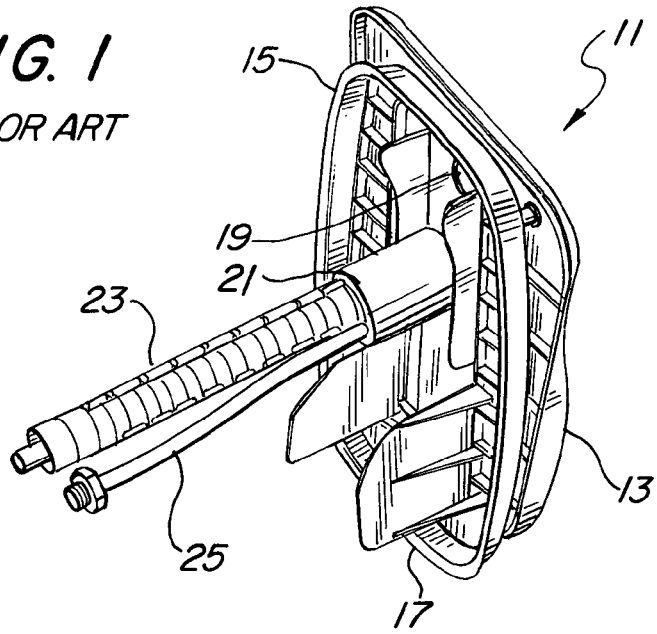
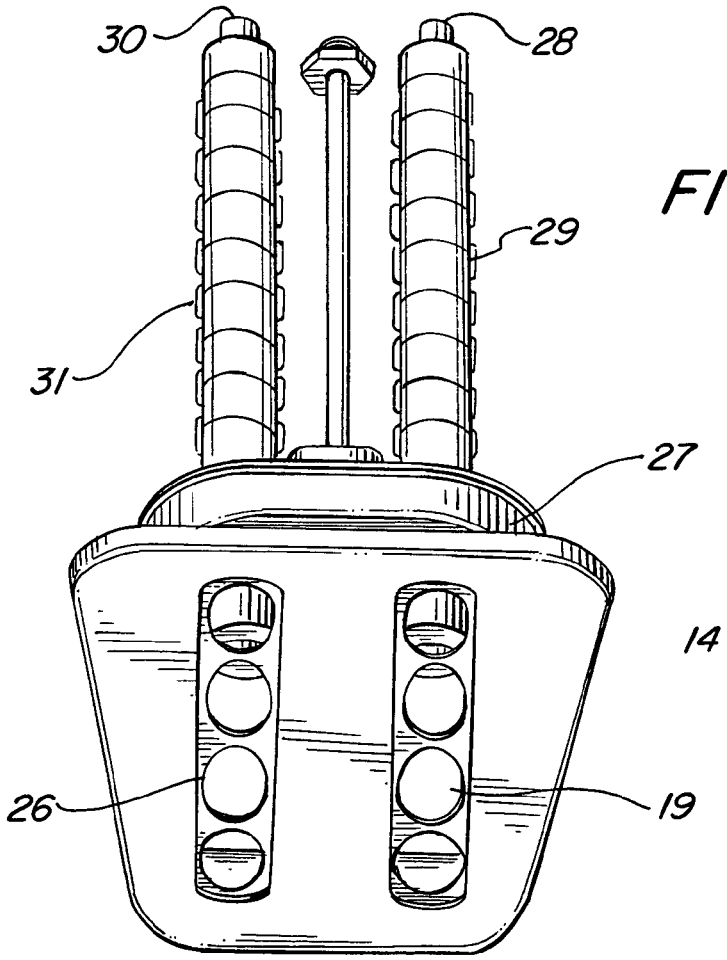
FIG. 2

MULTIPLE NOZZLE MOVING JET STRUCTURE FOR SPA

BACKGROUND OF THE INVENTION

1. Field of the Invention

The present invention relates generally to improvements in spas or hot tubs, and more particularly, pertains to new and improved nozzles for ejecting water into spas wherein, the nozzles physically moved.

2. Description of Related Art

In the field of providing moving water stream ejection into spa containers, it has been the practice to employ water tubes pivoting in a vertical plane to exhaust a massaging water stream on the back of the user sitting in the spa. One of the problems confronting such devices has been the problem of keeping the water tubes confined to movement in the vertical plane. Prior art devices such as, described in U.S. Pat. No. 4,523,340 granted Jun. 18, 1985 for a Means Providing Moving Water Stream Ejecting Into Spa Tank, U.S. Pat. No. 4,716,604 granted Jan. 5, 1988 for a Spa With Moving Jets, and U.S. Pat. No. 4,920,588 granted May 1, 1990 for a Means Providing Moving Water Stream Ejecting Into Spa Tank, utilized as specially designed guide body to guide the moving nozzles to move only in the vertical plane.

FIG. 1 is an illustration of a prior art, single nozzle moving jet structure. This type of structure is described in detail in U.S. Pat. Nos. 4,523,340, 4,716,604, and 4,920,588. These structures all have a single nozzle 21, connected to a source of air supply by tubing 25, and a source of pressurized water by tubing 23. The pressurized water is supplied to the nozzle 21 in a flexible tube encased in an articulated plastic sleeve structure. This articulated sleeve structure is more specifically described in U.S. Pat. No. 4,716,604, which is assigned to the assignee of the present invention. The nozzle 21 moves up and down vertically, as the result of a whipping reaction to the exhaust water from the nozzle. The nozzle 21 is confined to the vertical path of travel by the combination of the articulated plastic sleeve over tubing 23, and the guide body 17, which is a series of fins or ribs, as described in detail in U.S. Pat. No. 4,716,604. The water from the nozzle 21 is ejected through an opening or series of ports 19 on a face plate 13. Face plate 13 mounts to a flange 15 which is attached to the tank wall of the spa, in a manner described in detail in U.S. Pat. Nos. 4,523,340, 4,716,604 and 4,920,588.

In contrast, the present invention increases the amount of massaging water streams on the back of a user, while at the same time eliminating the requirement for using guide bodies and reducing the amount of air supply tubing line required.

SUMMARY OF THE INVENTION

A multiple nozzle structure mounted to respective pressurized water tubes which are individually encased in articulated sleeves with one air supply tube supplying air to all the nozzles, confines the nozzle structure movement resulting from the water exhaust, to one plane. No guide body is required to confine the direction of movement of the nozzle structure. Movement of the nozzle structure is preferred in the vertical plane to obtain movement up and down the back of a person in the spa.

BRIEF DESCRIPTION OF THE DRAWINGS

The exact nature of this invention, as well as its objects and many of the attended advantages, will become readily apparent upon reference to the following detailed description considered in conjunction with the accompanying drawings in which like reference numerals designate like parts throughout the figures thereof and wherein:

FIG. 1 is a back perspective of a prior art, single nozzle moving jet structure.

FIG. 2 is a top perspective of a multiple nozzle moving jet structure, according to the present invention.

DETAILED DESCRIPTION OF THE PREFERRED EMBODIMENTS OF THE INVENTION

Figure 3:
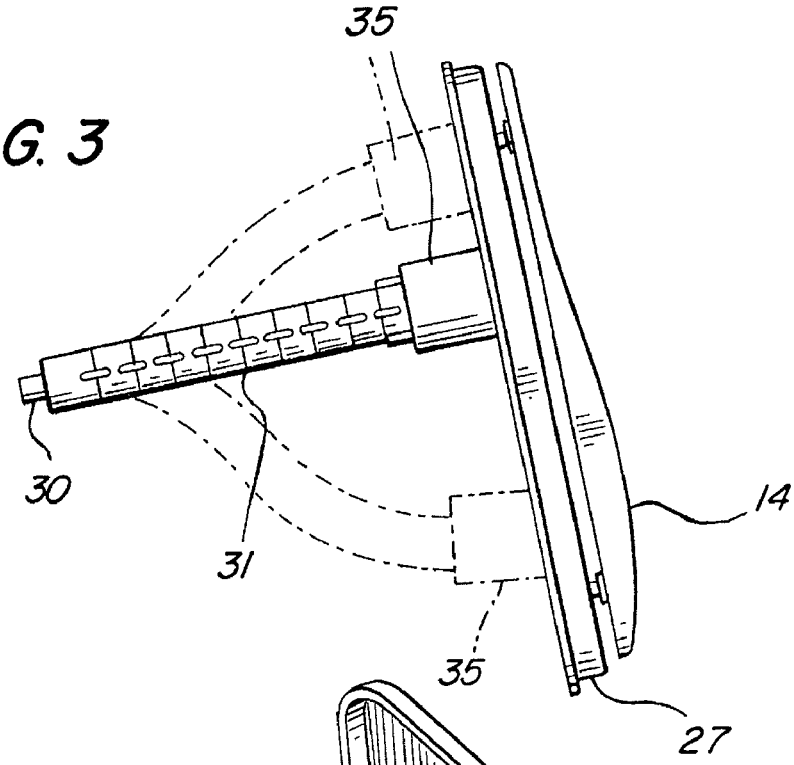
FIG. 3 is a side perspective of the multiple nozzle moving jet structure of FIG. 2.
Figure 4:
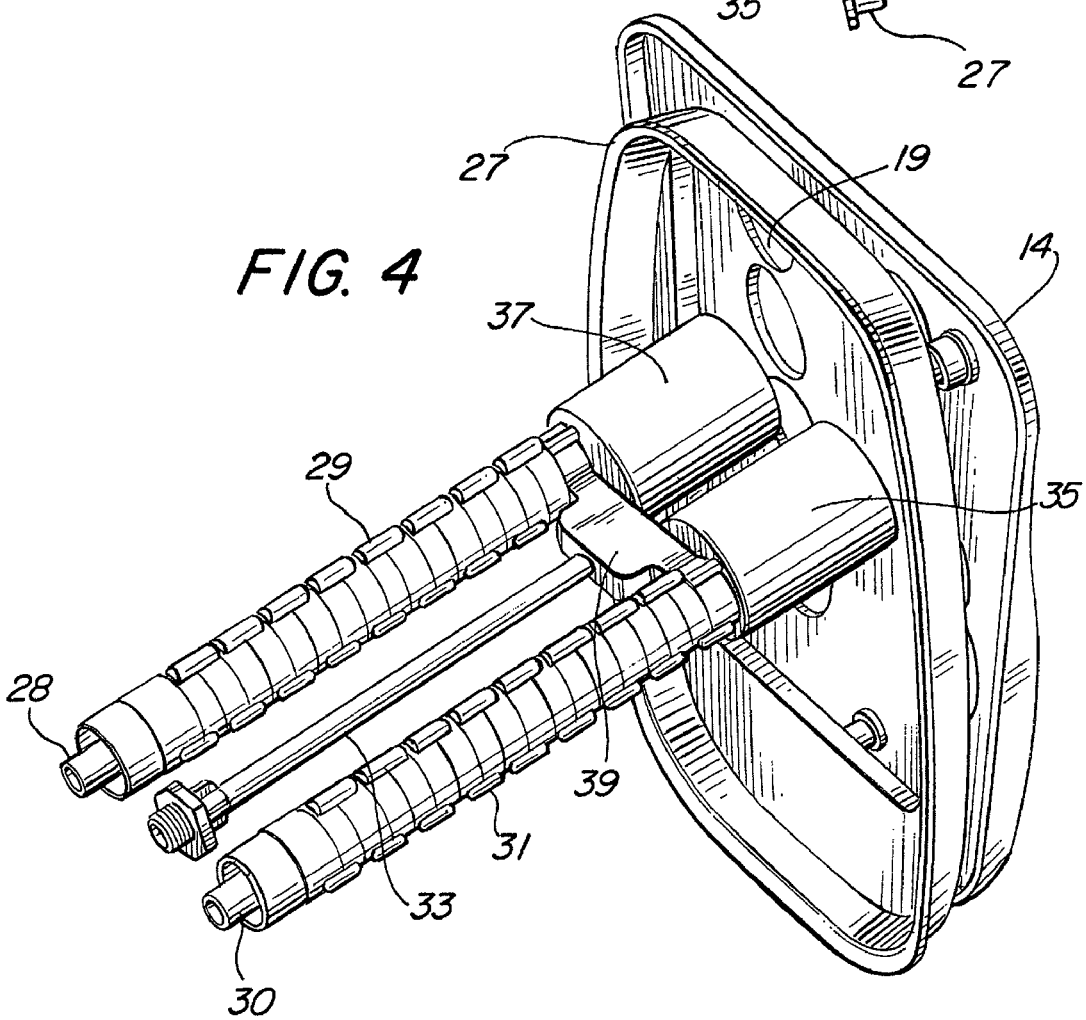
FIG. 4 is back perspective of the multiple nozzle moving jet structure of FIG. 2.

FIGS. 2, 3 and 4 illustrate a preferred embodiment of the present invention as having a two nozzle moving jet structure. Each nozzle 35, 37 is supplied with pressurized water over respective flexible tubing 30 and 28. A single air line 33 supplies air to an air manifold 39, which physically attaches to both nozzles 35 and 37 in a manner that makes the two nozzle 35 and 37 a single unit.

Each of the flexible water supply tubes 30 and 28 are encased in respective articulated plastic sleeves 31 and 29, of the type described in U.S. Pat. No. 4,716,604 granted Jun. 5, 1988 for a Spa With Moving Jets. The entire disclosure of U.S. Pat. No. 4,716,604 is incorporated herein by reference, as if fully set forth here.

The multiple articulated sleeves 29 and 31 in conjunction with the multiple jet 37, 35 moving structure, constrains movement of the multiple jet head 35, 37 to a single chosen plane, which in the figures is illustrated to be a vertical plane. Head 35, 37 moves in an up-down direction, back and forth, from a top location 35 to a bottom location 35', as shown in FIG. 3. It should be kept in mind, however, that the chosen plane could be other than vertical. The chosen plane could be horizontal, for example, or a plane at an angle to the horizontal, as desired.

At mounting flange 27, which is attached to the tank wall of the spa, acts as a support for the face plate 14, which has a first plurality of apertures 19 and a parallel second plurality of apertures 26 aligned vertically, to allow water being ejected from the nozzles 35 and 37 to be injected into the body of water in the spa (not shown).

The multiple nozzle moving jet structure of the present invention does not only eliminate the need for a guide body structure, for guiding nozzle movement, but it also provides a more significant quantity of massaging jets which is a quantum improvement to the experience of the occupant in the spa tank.

Figure 5:
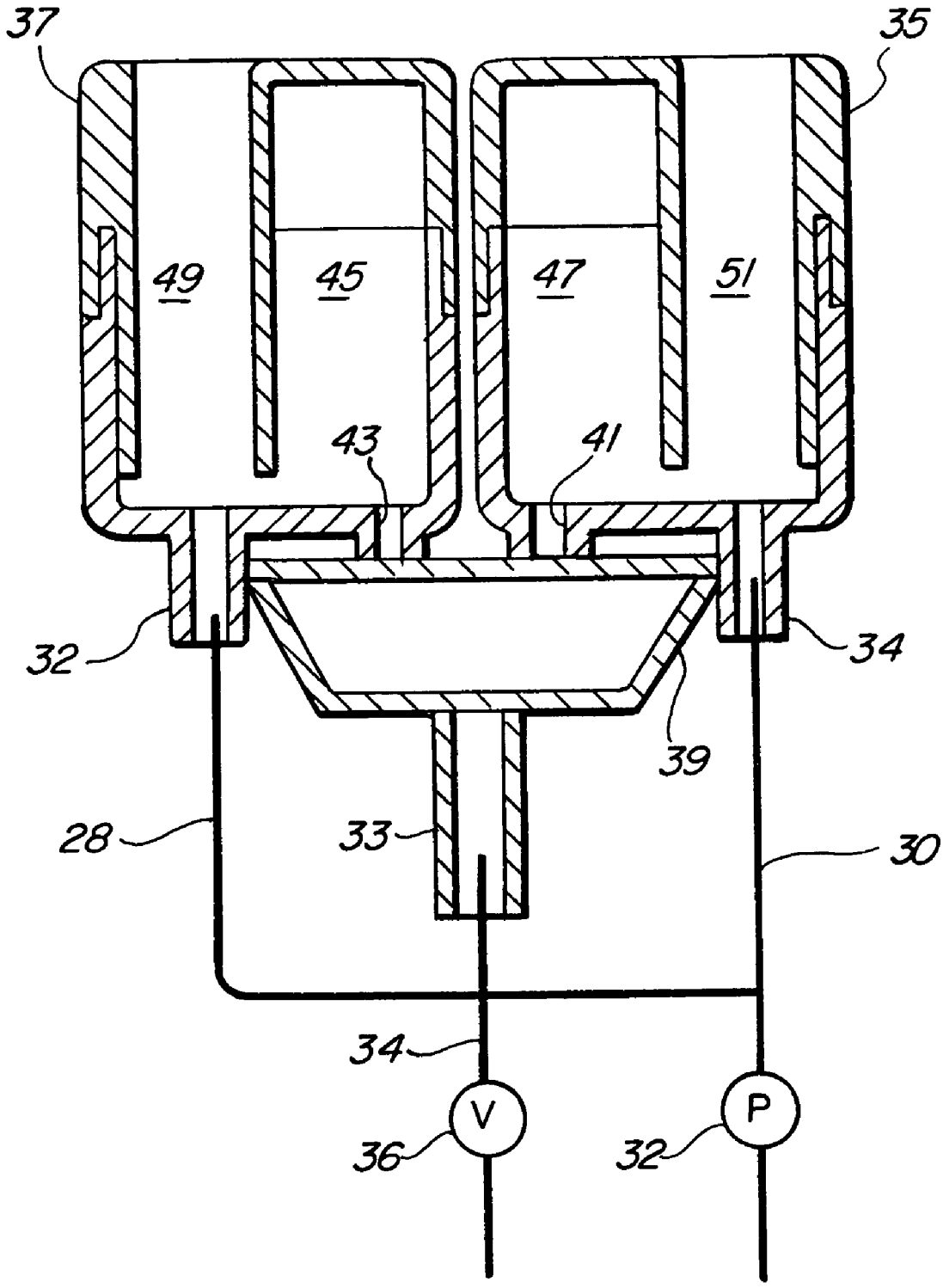
FIG. 5 is a cross section of a preferred embodiment of the multiple nozzle used in the multiple nozzle moving jet structure of the present invention.

An air manifold 39, which receives air from a flexible air supply tube 33, physically connects the jets 35 and 37 together, as well as supplying air to each of the jets, in a manner more clearly illustrated in FIG. 5.

FIG. 5, which is a cross section of a two nozzle moving jet structure shows the air manifold 39 receiving air by way of a flexible air supply line 33, from an air line 34 that is connected to a valve 36, which opens to the atmosphere. Air manifold 39 is connected to nozzle 35 by passage 41, and is connected to nozzle 37 by passage 43. Pressurized water is supplied to nozzle 35 by flexible tubing 30 that attaches to an input nipple 34. Flexible tubing 30 is connected to a pump 32, that pumps water from the spa tank. Nozzle 37 receives pressurized water over flexible tubing 28 from the pump 32. Tubing 28 attaches to the input nipple 32 of nozzle 37.

The structure of nozzles 35 and 37 are identical in that, each has an exhaust tube 51 and 49 with a space at the bottom for drawing air through the gap from respective air chambers 47 and 45. The specific operation of nozzles such as nozzles 35 and 37 is explained in detail in U.S. Pat. No. 4,920,588, the disclosure thereof being incorporated herein by reference, as if fully set forth here.

It should be remembered that more than two nozzles could be utilized in a multiple nozzle moving jet structure, according to the present invention, and using more than two nozzles is contemplated within the present invention. The arrangement of three or more nozzles in combination with the air manifold, using the nozzle structure illustrated, or an alternate nozzle structure, is considered part of the present invention.

What is claimed is:

1. A moving jet structure for a spa having a tank with sides containing water for body immersion and a source of pressurized water, the improvement comprising:

a plurality of flexible tubes connected to the source of pressurized water at a first end, each tube having a second end which will whip about in reaction to the pressurized water exhausting from the second end;

a plurality of articulated sleeves, an articulated sleeve encircling each one of the plurality of flexible tubes from the first end to the second end, each sleeve limiting the flexing of the tube to an arc with a change of direction at the end of the arc;

a manifold connecting together the plurality of articulated sleeves at the second end of the plurality of flexible tubes, the manifold, in combination with the plurality of articulated sleeves, constraining movement of the plurality of flexible tubes in unison to a vertical plane;

a plurality of nozzles, one nozzle for each one of the flexible tubes, connected to a flexible tube at the second end, each nozzle moving in unison with all the other nozzles in a vertical plane, the nozzles exhausting water into the tank from a side of the tank.

2. The moving jet structure of claim 1 further comprising:

an air supply for supplying air to the plurality of nozzles.

3. The moving jet structure of claim 1 wherein the manifold is connected to supply air to each of the plurality of nozzles.

4. The moving jet structure of claim 3 further comprising an air supply tube connected to the manifold and atmospheric air.

5. A moving jet structure for a spa having a tank with sides containing water for body immersion and a source of pressurized water, the improvement comprising:

two flexible tubes connected to the source of pressurized water at a first end, each tube having a second end which will whip about in reaction to the pressurized water exhausting from the second end;

two articulated sleeves, an articulated sleeve encircling each one of the two flexible tubes from the first end to the second end, each sleeve limiting the flexing of the tube to an arc with a change of direction at the end of the arc;

a manifold connecting together the two articulated sleeves at the second end of the flexible tubes, the manifold, in combination with the articulated sleeves, constraining movement of the flexible tubes in unison to a vertical plane;

two nozzles, a nozzle connected to the second end of a flexible tube, the nozzles moving in unison in a vertical plane, exhausting water into the tank from a side of the tank.

6. The moving jet structure of claim 5 further comprising an air supply for supplying air to the two nozzles.

7. The moving jet structure of claim 5 wherein the manifold is connected to supply air to each of the two nozzles.

8. The moving jet structure of claim 7 further comprising an air supply tube connected to the manifold and atmospheric air.

* * * * *